US007039979B2

(12) United States Patent
McFarland

(10) Patent No.: US 7,039,979 B2
(45) Date of Patent: May 9, 2006

(54) APPARATUS FOR MAINTAINING PRESSURE ON UNDERWATER VACUUM CLEANING DEVICE

(76) Inventor: Greg McFarland, 127 Wood Ave., Staten Island, NY (US) 10307

( * ) Notice: Subject to any disclaimer, the term of this patent is extended or adjusted under 35 U.S.C. 154(b) by 273 days.

(21) Appl. No.: 10/136,822

(22) Filed: Apr. 30, 2002

(65) Prior Publication Data

US 2003/0000029 A1 Jan. 2, 2003

Related U.S. Application Data

(60) Provisional application No. 60/292,122, filed on May 18, 2001.

(51) Int. Cl.
*E04H 4/16* (2006.01)

(52) U.S. Cl. ..... 15/1.7; 15/246; 15/160

(58) Field of Classification Search ..... 15/1.7, 15/246, 160, 246.1
See application file for complete search history.

(56) References Cited

U.S. PATENT DOCUMENTS 3,003,168 A * 10/1961 Shouldice ..... 15/1.7
4,637,087 A * 1/1987 Feinberg ..... 15/1.7
4,733,427 A 3/1988 Conrad
4,742,592 A * 5/1988 Addona, Sr. ..... 15/246
4,776,053 A 10/1988 Kiraly
4,783,868 A 11/1988 O'Callaghan
4,962,558 A * 10/1990 Harrell, Jr. ..... 15/1.7
5,487,397 A * 1/1996 Bean ..... 134/6
5,539,947 A 7/1996 Kiraly
5,864,917 A * 2/1999 Landsman ..... 15/246

* cited by examiner

*Primary Examiner*—Richard Crispino
*Assistant Examiner*—Abraham Bahta
(74) *Attorney, Agent, or Firm*—Ostrolenk, faber, Gerb & Soffen, LLP

(57) ABSTRACT

Apparatus for maintaining pressure on a liquid pool cleaning device has an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device.

18 Claims, 7 Drawing Sheets

APPARATUS FOR MAINTAINING PRESSURE ON UNDERWATER VACUUM CLEANING DEVICE

CROSS REFERENCE TO RELATED APPLICATIONS

The present application claims the priority and benefit of U.S. Provisional application Ser. No. 60/292,122, filed May 18, 2001 and entitled "DEVICE FOR MAINTAINING PRESSURE ON UNDER WATER VACUUM CLEANING DEVICE", the entire disclosure of which is hereby incorporated by reference.

BACKGROUND OF THE INVENTION

The present invention relates to devices for cleaning tanks of fluids, and in particular, to devices for cleaning swimming pools. More particularly, the present invention relates to fluid suction or vacuum systems for cleaning swimming pools, and even more particularly, to a device for maintaining contact pressure on a vacuum cleaning head against the floor of a swimming pool.

Vacuum swimming pool cleaning devices are well known. In the typical application, a vacuum swimming pool cleaning head comprises a hollow fixture with an open bottom enclosing a space which may include cleaning or brush elements and which is connected to a suction or vacuum hose providing suction from the swimming pool filter pump. The suction hose draws liquid away from the head and any dirt particles and debris away from the head to the filter as the cleaning head is moved across the pool floor.

A common problem with such vacuum cleaning heads is that there is a tendency for the head to rise from the floor of the swimming pool, despite the application of vacuum by the filter pump. This occurs sometimes when the user moves the head, for example. This can cause dirt particles to be disturbed near the head and accordingly, not to be sucked up by the suction applied by the filter pump.

There are a number of liquid pool cleaning devices which have been developed for assisting in maintaining contact pressure. For example, U.S. Pat. No. 4,783,868 to O'Callahan shows such a device which is provided at the head of a brush. It uses a pivoting vane that applies pressure during forward motion and then pivots to a nonimpeding position upon backward motion. Although this device is useful for pool cleaning brushes, it is not useful for vacuum heads because the vane is located too close to the vacuum head and accordingly will create fluid dynamics which will cause dirt particles and debris on the pool floor to be moved prior to their being vacuumed by the vacuum head. Further, this device shows a device which only increases contact pressure in a forward motion and provides a non-impeding position on a backward motion. With vacuum cleaning of pools, it is common to vacuum in both forward and backward directions. Accordingly, this device would not provide additional contact pressure when moving in a backward direction. A similar device is shown in U.S. Pat. No. 4,733,427 to Conrad. It suffers from the same problem.

Another device is shown in U.S. Pat. No. 4,637,087 to Feinberg. This device uses flaps to allow contact pressure to be provided in one direction and then act as a check valve in the second direction so as to avoid providing contact pressure. Further, this device is provided to clean the walls of swimming pools and not the bottoms. This device also would not be adaptable to a vacuum cleaning head because the water foil thereof is attached too close to the brush head and thus could disturb debris and further, provides for only increasing the contact pressure in one direction only.

Other patents of interest include U.S. Pat. No. 4,742,592 to Addona, Sr. which is also a wall scrubbing device and has some as the same disadvantages of the prior art discussed above. Also see U.S. Pat. Nos. 5,539,947 and 4,766,053 which disclose hydrofoils for vacuum cleaner heads. However, the '053 patent provides for downward thrust only during the pulling stroke. The device of the '947 patent provides downward thrust during both pulling and pushing strokes but in this device, as in the device of the '053 patent, the hydrofoil is mounted on the vacuum cleaning head itself and can create fluid dynamics which would interfere with proper cleaning by disturbing debris on the pool floor.

SUMMARY OF THE INVENTION

It is an object of the present invention to provide a vacuum cleaning device for swimming pools which assists in maintaining greater pressure on the vacuum cleaning head than is provided by the mere weight of the vacuum cleaning head and the pole attached thereto and the vacuum exerted by the filter pump.

It is furthermore an object of the present invention to provide a vacuum cleaning device for swimming pools which increases contact pressure in both forward and backward directions.

It is yet further an object of the present invention to provide a device for increasing contact pressure of vacuum cleaning heads in swimming pools which does not interfere with cleaning effort by creating unnecessary fluid dynamics which would cause disturbance of debris and dirt on the floor of a swimming pool prior to being vacuum cleaned.

The above and other objects of the invention are achieved by an apparatus for maintaining pressure on a liquid pool vacuum cleaning device comprising: an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device.

According to another aspect, the invention comprises an apparatus for maintaining pressure on a liquid pool cleaning device comprising an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device, wherein the object comprises two vanes having an included angle between the vanes, one of said vanes exerting a downward force on the cleaning head in the forward direction and the second vane exerting a downward force on the cleaning head in the rearward direction.

According to yet another aspect, the invention comprises an apparatus for maintaining pressure on a liquid pool cleaning device comprising an object for attachment to the liquid pool cleaning device, the object being movable so that it moves into a first orientation to exert a downward force on the liquid pool cleaning device when the cleaning device is moved in the forward direction and attains a second orientation to exert a downward force on the liquid pool cleaning device when the liquid pool cleaning device is moved in the rearward direction.

Other features and advantages of the present invention will become apparent from the following description of the invention which refers to the accompanying drawings.

BRIEF DESCRIPTION OF THE DRAWING(S)

The invention will now be described in the following detailed description with reference to the drawing in which.

DETAILED DESCRIPTION OF EMBODIMENTS OF THE INVENTION

Figure 2:
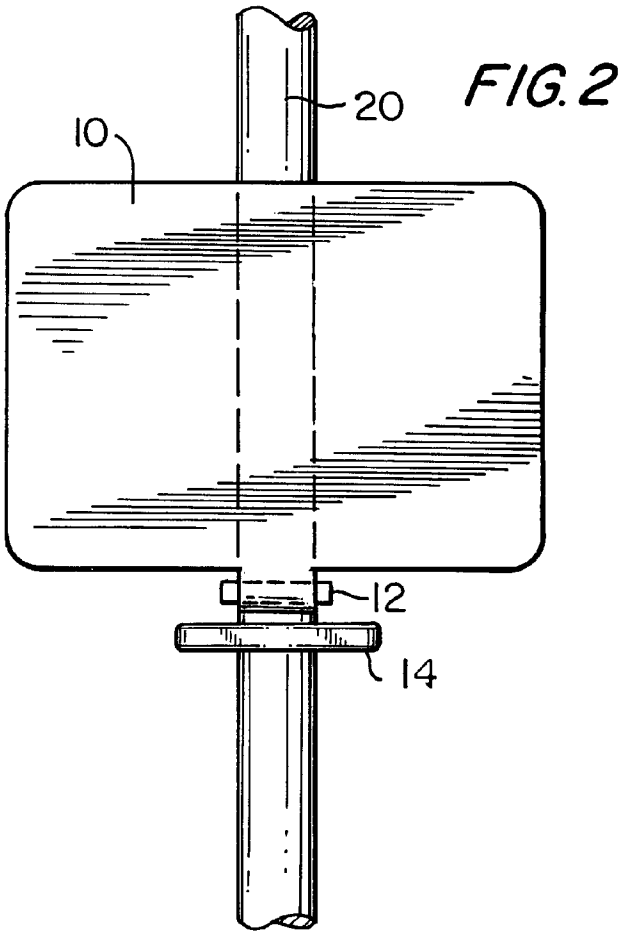
FIG. 2 shows a plan view of the first embodiment according to the present invention.
Figure 1:
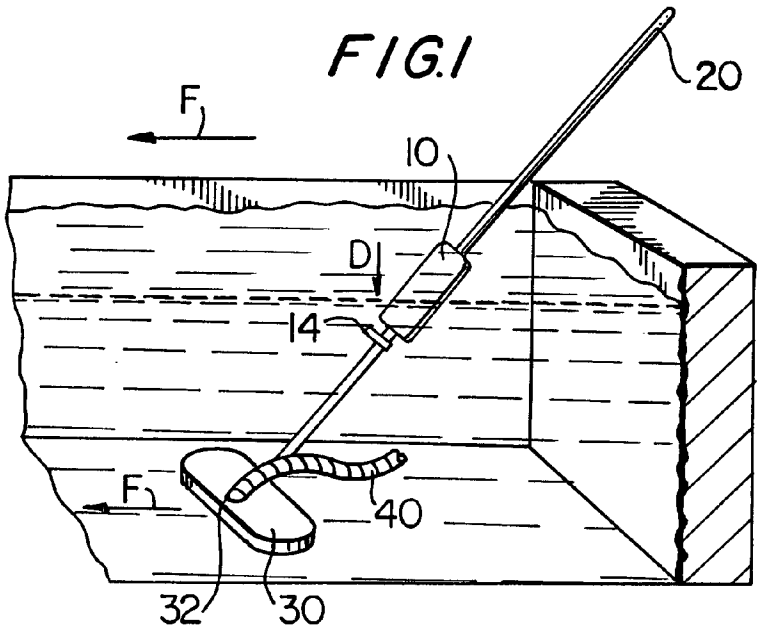
FIG. 1 is a perspective view of a first embodiment according to the invention showing the vacuum cleaning device being operated in a forward direction.
Figure 3A:
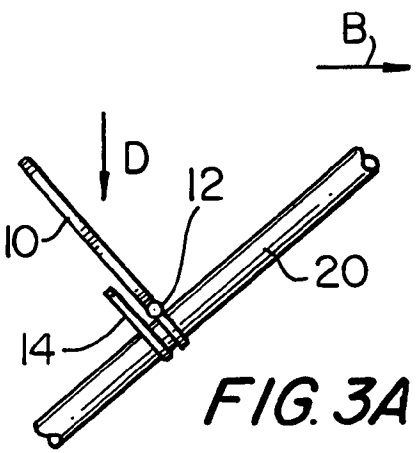
FIG. 3A shows a detail of the device shown in FIG. 3.
Figure 3:
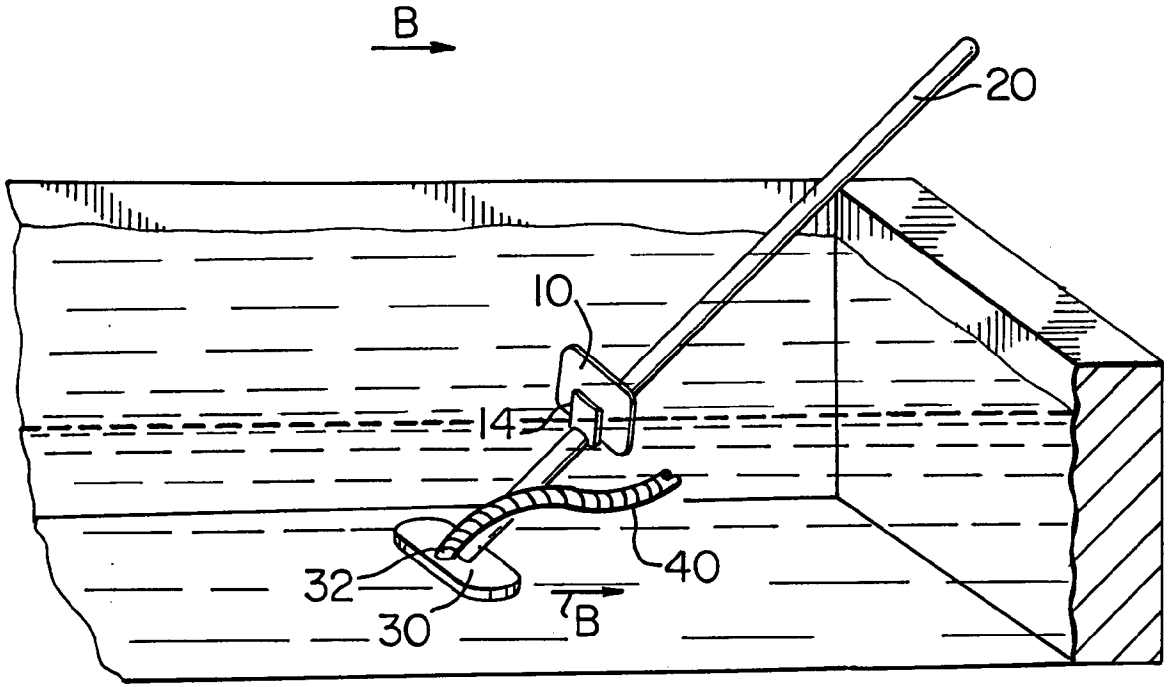
FIG. 3 shows a perspective view of the first embodiment when the pool vacuum cleaning device is being moved in a rearward direction.

With reference to the drawing figures, FIGS. 1–3 show one embodiment of a device according to the present invention for accomplishing the above objects. The device comprises in the embodiment of FIGS. 1–3, a vane 10 which is attached to the pole 20 of a swimming pool vacuum cleaner whose vacuum cleaning head is shown at 30. A flexible suction or vacuum hose 40 is coupled to an inlet 32 of the head 30 in conventional fashion. The vacuum hose 40 is connected in conventional fashion to a swimming pool filter pump, not shown. Typically, the hose 40 is connected to the filter skimmer inlet or other source of reduced liquid pressure or suction, as well known to those of skill in the art.

The vane 10 can be coupled to the pole 20 by any suitable means, for example, by a U-bolt. In this embodiment, the vane is pivotally coupled as shown in FIG. 2 on a pivot axis 12, which may comprise a suitable bolt, screw or other fastener. A snap fastener of any type can also be utilized.

Figure 1A:
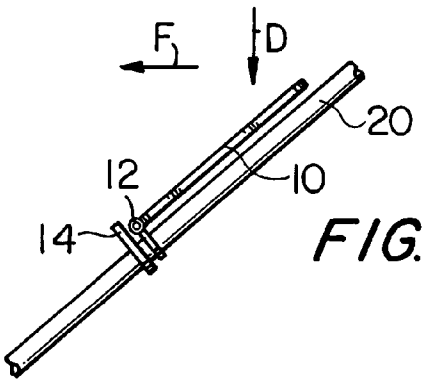
FIG. 1A shows a detail of FIG. 1.

As shown in FIG. 1, when a person is cleaning the swimming pool by moving the pole in the forward direction shown by the arrow designated F in FIG. 1, force D of fluid pressure caused by the forward movement of the vacuum cleaning head 30 and pole 20 in the direction F will cause the vane 10 to firmly lie against the pole. Preferably, the vane 10 is made of a rigid material such as a rigid plastic or metal which does not increase the buoyancy of the cleaning device. It may be made of a clear plastic material to minimize interference with viewing the cleaning operation. FIG. 1A shows a side view of the vane 10, firmly planted against the pole 20 when moving in the forward direction F by the force D.

FIGS. 3 and 3A show the same device but being used in a swimming pool when the head 30 is moved in a reverse direction B. As shown, the vane 10 pivots on its axis 12, and comes to rest against a stop 14 which prevents the vane from moving further. On the backward stroke, as shown in side view in FIG. 3A, downward force D created by water pressure is exerted against the vane 10, causing the pole 20 and accordingly the head 30 to be pressed downwardly, increasing the contact pressure of the head 30 with the pool bottom.

Figures 4, 4A:
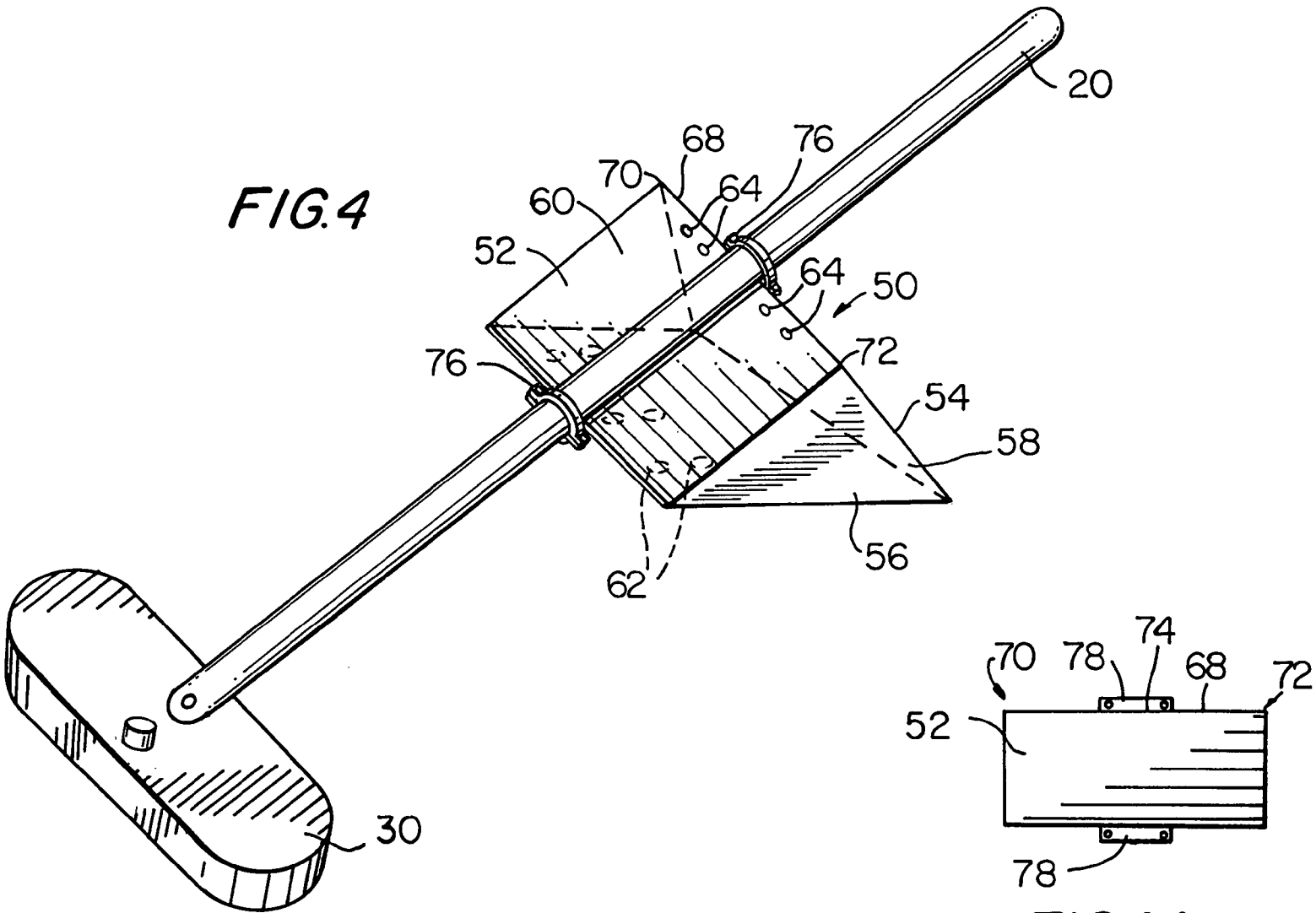
FIG. 4 shows a second embodiment of the present invention.
FIG. 4A shows a modified detail of FIG. 4 in a rear view.

FIG. 4 shows another embodiment of the invention. In this embodiment, a fixed triangular structure 50 having two upwardly directed surfaces 52 and 54 and a bottom surface 56 are provided. The structure may be closed by end surfaces 58 and 60 in which case the bottom surface 56 is provided with a plurality of holes 62 to allow water to enter. Holes are also preferably provided along the top corner at 64 on the two surfaces 52 and 54 to allow any air to escape within the inner chamber created by the triangular structure 50.

Holes 62 on the bottom surface (FIG. 5) are not necessary if the triangular structure does not include end walls 58 and 60 since fluid can easily enter from the open sides into the volume below the surfaces 52 and 54. Also, holes 64 are not necessary if ends 58 and 60 are open and if the top corner 68 is formed so as to have an arcuate surface with the corners 70 and 72 being higher than the central portion 74, as shown in FIG. 4A.

Figure 7:
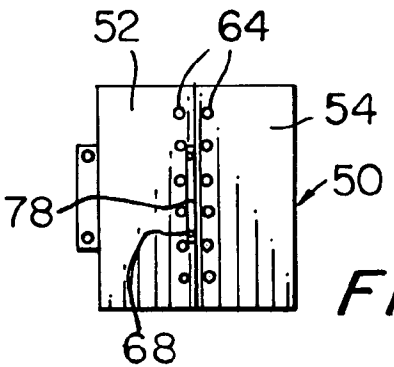
FIG. 7 shows a top view of a portion of the device of FIG. 4.
Figure 4B:
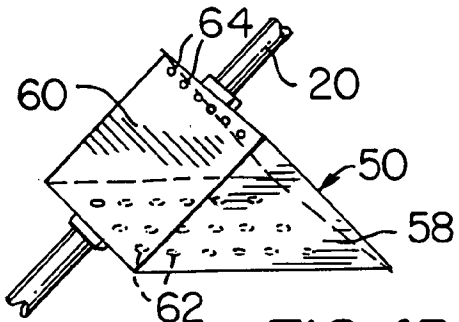
FIG. 4B shows a detail of FIG. 4 in a perspective view.

The triangular structure 50 may be attached to the pole 20 via any attachment means, for example, U-bolts 76 through bracket members 78 attached to the triangular structure 50. FIG. 4B shows an embodiment of this structure 50 that has closed ends 58 and 60 and having a bottom surface including holes 62 to allow fluid to enter. FIG. 7 shows a top view of the device 50.

Figure 6:
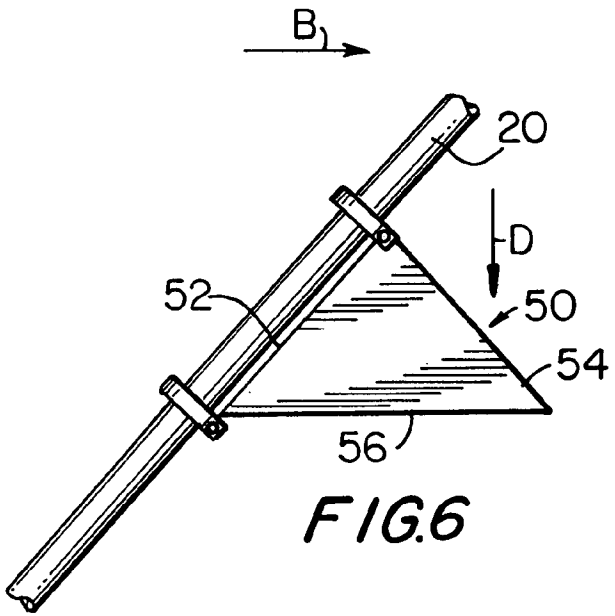
FIG. 6 shows a detail of the device of FIG. 4 when the vacuum cleaning device is being moved in a rearward direction.
Figure 5:
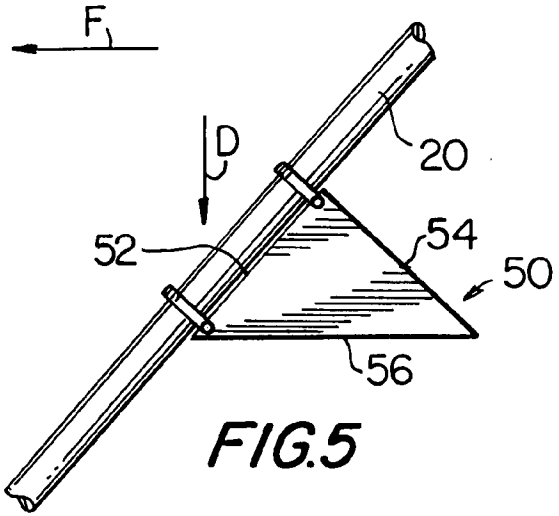
FIG. 5 shows a detail of the device of FIG. 4 when the vacuum cleaning device is being moved in a forward direction.

FIGS. 5 and 6 show, respectively, how the device 50 operates on a forward motion of the vacuum cleaning head 30, as shown by the arrow F in FIG. 5 and on a rearward motion shown by arrow B of FIG. 6. A downward force is exerted as shown by the arrow D on the surface 52 as the pole is moved in the forward direction F. This causes the contact pressure of the cleaning head 30 against the bottom surface of the pool to be increased. On a backward motion, as shown in FIG. 6, and as indicated by the arrow B, a downward force D is generated against the surface 54 and thus against the pole 20 and cleaning head 30, thus increasing the contact pressure of the cleaning head 30 against the pool bottom. In both FIGS. 5 and 6, the bottom surface 56 has no effect because it essentially slides through the water horizontally.

Figure 8:
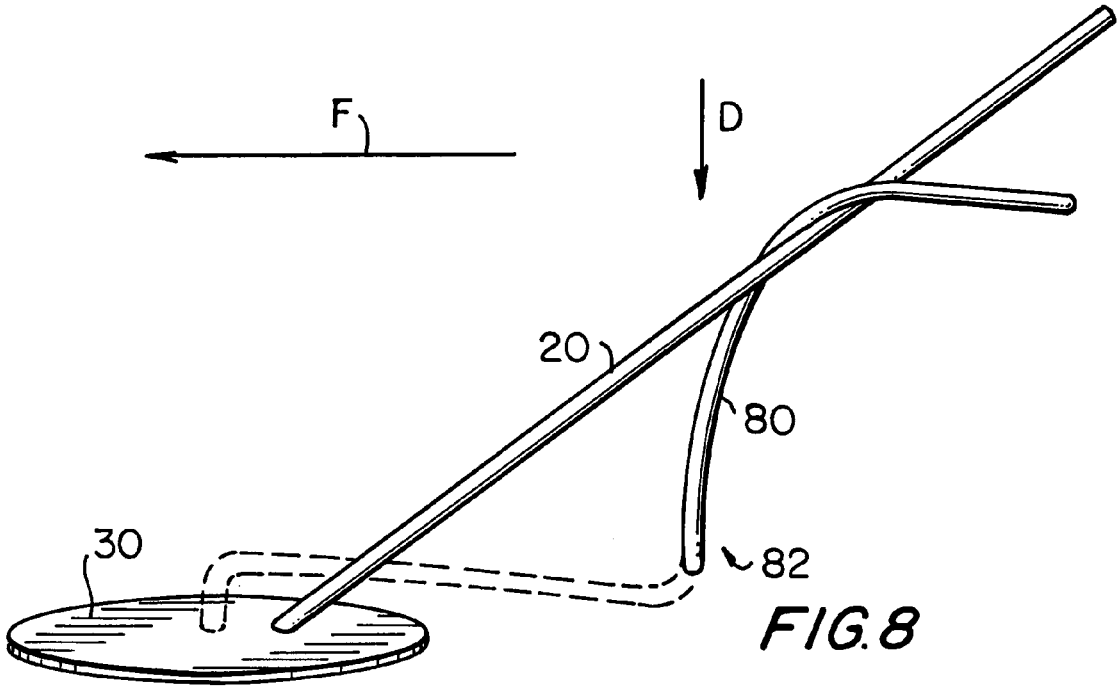
FIG. 8 shows a third embodiment according to the present invention when the vacuum cleaning device is being moved in a forward direction.
Figure 9:
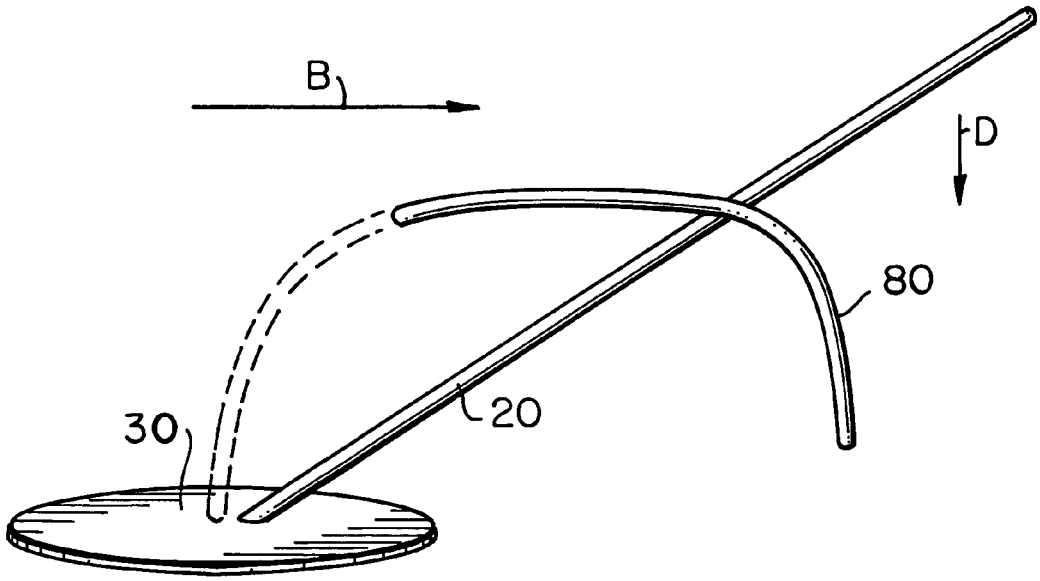
FIG. 9 shows the device of FIG. 8 when the vacuum cleaning device is being moved in a rearward direction.

FIGS. 8 and 9 show a third embodiment of the invention. In FIGS. 8 and 9, the pole 20 and head 30 are shown schematically. In this embodiment of the invention, the device for increasing contact pressure of the head 30 on the pool bottom is provided by a hollow bendable tube 80 suitably attached to the pole 20, e.g., with a U-bolt, not shown. In a forward direction F, the forward end of the tube 80 will bend downwardly due to water resistance, as shown at 82 in FIG. 8. The water will enter the tube 80 to prevent buoyancy. The fluid resistance as the cleaning device is pushed through the water in the forward direction indicated by the arrow F will exert a downward pressure on the pole and the cleaning head 30. FIG. 9 shows the same device moving in the backward direction B. In this case, the proximal end of the tube 80 will be forced downwardly by fluid resistance and a downward force will be generated on the tube 80 which will be transferred to the pole 20 and accordingly, the cleaning head 30, thus increasing the contact pressure of the cleaning head 30 on the pool bottom. This tube may also be the vacuum hose as shown by the dashed lines in FIGS. 8 and 9. The tube is made sufficiently flexible so that it will bend as required.

Figure 10:
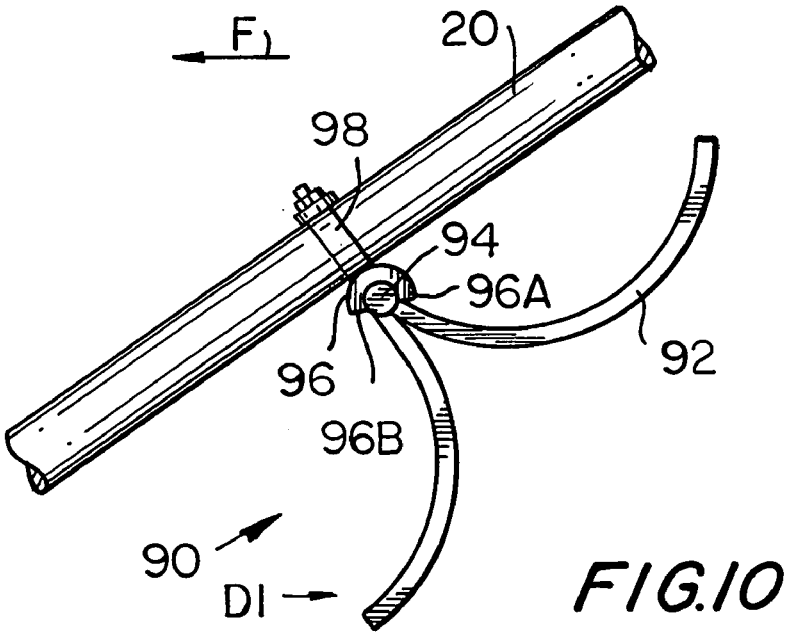
FIG. 10 shows a fourth embodiment in a side view showing the device being operated in a forward direction.
Figure 11:
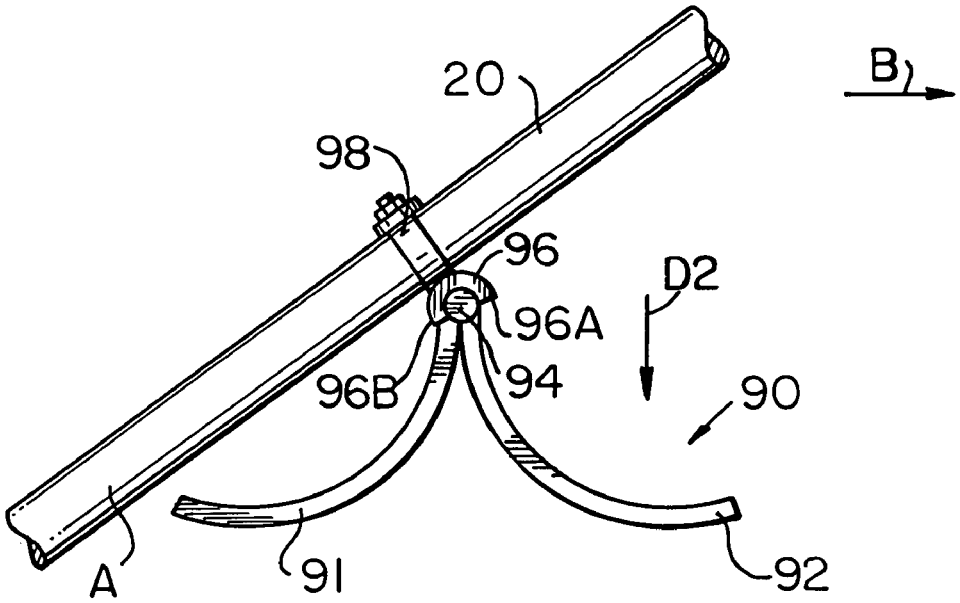
FIG. 11 shows the fourth embodiment in a side view being operated in the rearward direction.
Figure 12:
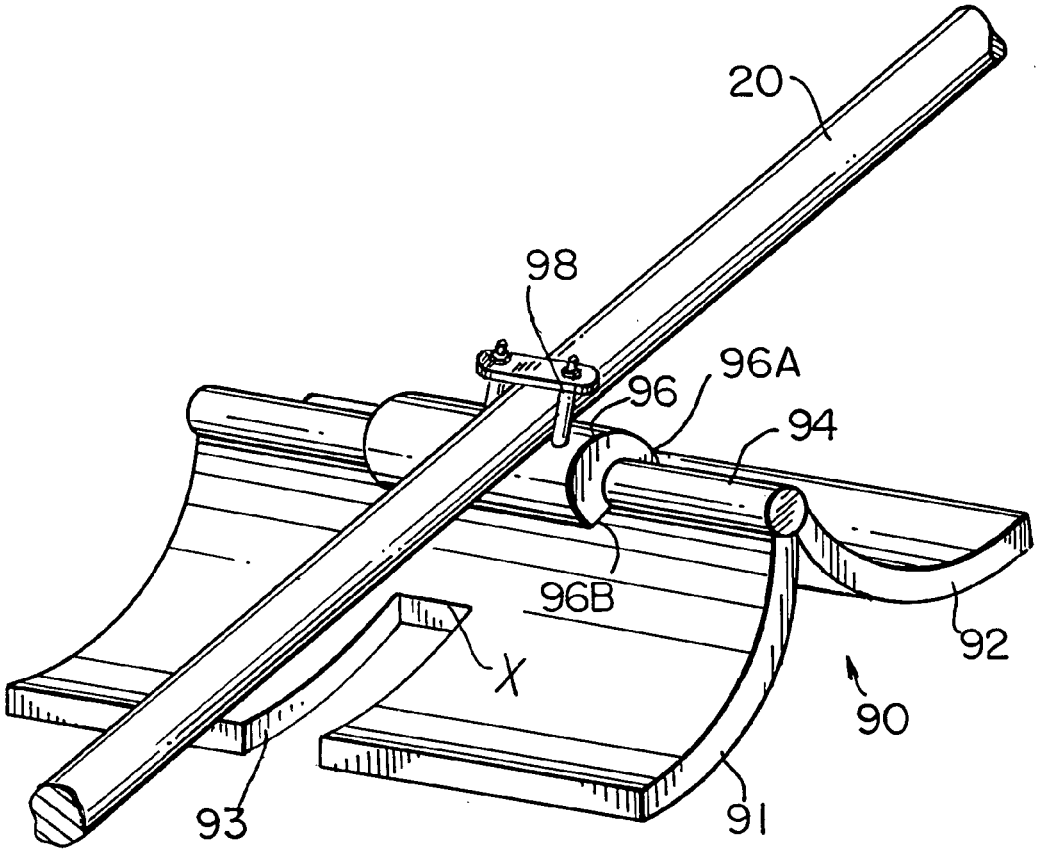
FIG. 12 shows a perspective view of the fourth embodiment.

FIGS. 10 to 12 show a fourth embodiment of the invention. FIG. 12 shows a perspective view and FIGS. 10 and 11 show respectively, the orientation of the device when the pole 20 is moved in the forward direction F and in the rearward direction B.

As shown, the device comprise a dual vane member 90, comprising two vane members 91 and 92 fixedly attached to each other and mounted to a common pivot 94 which may comprise an axially disposed pin in a hinge member 96 which allows a limited degree of rotation. The hinge member 96 has two stops 96A and 96B which provide stops for the pivoting action of the dual vane member 90 in, respectively, the forward and rearward direction of movement. The hinge member 96 may be mounted to the pole 20 by a suitable attachment means, for example a U bolt 98.

As shown in FIGS. 10 and 11, in the forward direction F of the pole 20, water pressure due to the forward movement F as indicated by D1 in FIG. 10 will cause the dual vane member 90 to pivot to the orientation shown. The vane member 90 will pivot through an angle defined by the stop member 96A. The pressure D1 due to the fluid action on the vane 91 as the pole is moved in the forward direction F will cause an increased downward pressure or torque to be exerted on the pole 20 and accordingly on the cleaning head. In the rearward direction shown by the arrow B in FIG. 11, the fluid force D2 will act on the vane 92 causing a downward force on pole 20 and thus provide increased pressure on the cleaning head 30.

It is also not necessary to provide a stop 96B because the vane 91 will automatically be stopped by the pole at A (FIG. 4). Also, a slot can be provided in the vane 91 as shown at 93 in FIG. 12. This will allow the vane member 90 to pivot somewhat past the pole 20 in direction B in which case the vane 91 is stopped by the surface X of the slot against the pole 20 (FIG. 12). Similarly, the stop 96A can also be removed with the vane 92 also stopping against the pole 20.

Although the invention shows a hinge 94, 96 having a limited degree of pivoting motion defined by stops 96A and 96B, separate stop members can be provided to stop the pivoting motion of the vanes 91 and 92 and the hinge 94, 96 need not have both the stop members.

Further, the invention may also operate without a hinge 94, 96. In such embodiment, the dual vane member 90 is fixed, non-pivotally attached to pole 20. Vane member 91 provides downward force in direction F and vane members 92 provides downward force in direction B.

As shown in the various drawings, the device 10, 50, 80, 90 operates to increase the contact pressure of the head 30 with the pool bottom both in the forward and backward directions. A force being generated by the fluid pressure on the device 10, 50, 80, 90 is transferred to the pole 20 and thus the cleaning head 30 to increase the contact pressure of the cleaning head 30 with the bottom surface. Additionally, the device 10, 50, 8, 90 is provided on the pole at a position distant from the cleaning head 30 so as not to disrupt debris and dirt to be vacuumed on the pool floor.

In the embodiment of FIGS. 10 to 12, each vane may have a surface area of approximately 6 inches×9 inches.

Further, although he invention has been described for use with underwater vacuum cleaning equipment, it is also applicable to other liquid pool cleaning devices, such as, e.g., scrub brushes and swabs.

The invention can be added or affixed to a standard pole, or manufactured as part or a new type pole.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. Apparatus for maintaining pressure on a liquid pool cleaning device comprising:

an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device; further wherein the object is movable so that the object moves into a first orientation to exert a downward force on the liquid pool cleaning device when the liquid pool cleaning device is moved in the forward direction and attains a second orientation to exert a downward force on the liquid pool cleaning device when the liquid pool cleaning device is moved in the rearward direction;

further comprising an attaching mechanism for attaching the object to the liquid pool cleaning device;

wherein the liquid pool cleaning device includes a cleaning head and a pole for manipulation by a user, and further wherein the attaching mechanism attaches the object to the pole; further wherein the pole has a first end adjacent the head and a second end distally disposed from the first end, and wherein the attaching mechanism attaches the object at a point between the first and second ends; and further wherein the object comprises a vane, the vane being hingedly attached to the attaching mechanism whereby the vane attains said first orientation when the cleaning device is moved in the forward direction and the second orientation when the cleaning device is moved in the rearward direction; and the pole has an axis and the vane is disposed above the pole above the axis of the role and the first orientation comprises a position approximately parallel to and adjacent to the pole and the second orientation comprises a position disposed at an angle with respect to the axis of the pole;

further wherein the vane moves through at least approximately 90° between the first orientation and the second orientation, wherein the object comprises two vanes having an included angle between the vanes, one of said vanes exerting a downward force on the cleaning head in the forward direction when the object attains the first orientation and the second vane exerting a downward force on the cleaning head in the rearward direction when the object attains the second orientation.

2. The apparatus of claim 1, wherein the two vanes are pivotal as a unit.

3. The apparatus of claim 1, wherein each of the two vanes are curved opposite each other.

4. The apparatus of claim 1, wherein the two vanes are disposed below a pole attached to the cleaning head.

5. The apparatus of claim 1, wherein the object is made from a transparent material.

6. The apparatus of claim 1, wherein the object is made from an opaque material.

7. The apparatus of claim 1, wherein the attaching mechanism comprises at least one U bolt.

8. The apparatus of claim 1, wherein the cleaning device comprises a pool vacuum cleaning device.

9. Apparatus for maintaining pressure on a liquid pool cleaning device comprising:

an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device;

further comprising an attaching mechanism for attaching the object to the liquid pool cleaning device;

wherein the liquid pool cleaning device includes a cleaning head and a pole for manipulation by a user, and further wherein the attaching mechanism attaches the object to the pole; further wherein the object comprises a triangular member having three surfaces;

further wherein the triangular member is fixed to the pole attached to the cleaning head and wherein the triangular member is not pivotable, further wherein the triangular member has three approximately planar surfaces with open ends.

10. The apparatus of claim 9, further wherein the attaching mechanism comprises plural attaching points for attaching the triangular member to the pole.

11. The apparatus of claim 9, wherein the pole has an axis and the triangular member is attached to the pole below the pole below the axis of the pole.

12. The apparatus of claim 9, wherein the triangular member is disposed such that a longitudinal axis of the triangular member is disposed perpendicular to the pole and parallel to a surface of the liquid pool when in use.

13. The apparatus of claim 9, wherein in the forward direction, a distal face of the triangular member exerts a downward force on the cleaning device and in a backward direction a proximal face of the triangular member exerts a downward force on the cleaning device.

14. The apparatus of claim 9, wherein the triangular member has a bottom face with the bottom face being provided with a plurality of apertures for the admission of fluid into the interior of the triangular member.

15. Apparatus for maintaining pressure on a liquid pool cleaning device comprising:

an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device;

further comprising an attaching mechanism for attaching the object to the liquid pool cleaning device;

wherein the liquid pool cleaning device includes a cleaning head and a pole for manipulation by a user, and further wherein the attaching mechanism attaches the object to the pole; further wherein the object comprises a triangular member having three surfaces;

further wherein the triangular member is fixed to the pole attached to the cleaning head and wherein the triangular member is not pivotable, further wherein the triangular member has three longitudinally oriented corners, one of said corners forming an upward concave curve.

16. Apparatus for maintaining pressure on a liquid pool cleaning device comprising:

an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device;

further comprising an attaching mechanism for attaching the object to the liquid pool cleaning device; further wherein the liquid pool cleaning device includes a cleaning head and a pole for manipulation by a user, and further wherein the attaching mechanism attaches the object to the pole; further wherein the pole has a first end adjacent the head and a second end distally disposed from the first end, and wherein the attaching mechanism attaches the object at a point between the first and second ends; and wherein the object comprises a hollow bendable tube attached to the attaching mechanism and disposed so that a projection of the tube, when viewed from above, is substantially parallel to the pole and wherein, in the forward direction, a distal portion of the tube bends downwardly and a force is exerted on the forward end of the tube to exert a downward force on the cleaning device, and in the rearward direction, a proximal portion of the tube bends downwardly and exerts a downward force on the cleaning device.

17. Apparatus for maintaining pressure on a liquid pool cleaning device comprising:

an object for attachment to the liquid pool cleaning device, the object having first and second surfaces, the first surface generating a force due to liquid pressure on the first surface causing a downward force on the liquid pool cleaning device in a forward direction of the cleaning device and the second surface generating a force due to liquid pressure on the second surface causing a downward force on the liquid pool cleaning device in a rearward direction of the cleaning device;

further comprising an attaching mechanism for attaching the object to the liquid pool cleaning device; further wherein the liquid pool cleaning device includes a cleaning head and a pole for manipulation by a user, and further wherein the attaching mechanism attaches the object to the pole; further wherein the pole has a first end adjacent the head and a second end distally disposed from the first end, and wherein the attaching mechanism attaches the object at a point between the first and second ends; and further wherein the object is hingedly attached to the attaching mechanism whereby the object attains a first orientation when the cleaning device is moved in the forward direction and a second orientation when the cleaning device is moved in the rearward direction;

further wherein the object moves through at least approximately 90° between the first orientation and the second orientation; and wherein the object comprises two vanes having an included angle between the vanes, one of said vanes exerting a downward force on the cleaning head in the forward direction and the second vane exerting a downward force on the cleaning head in the rearward direction.

18. The apparatus of claim 17, wherein each of the vanes is curved opposite to each other.

* * * * *